US010036234B2

(12) United States Patent
Sponchia et al.

(10) Patent No.: US 10,036,234 B2
(45) Date of Patent: Jul. 31, 2018

(54) LATERAL WELLBORE COMPLETION APPARATUS AND METHOD

(71) Applicant: Schlumberger Technology Corporation, Sugar Land, TX (US)

(72) Inventors: Barton Sponchia, Cypress, TX (US); Lance M. Rayne, Spring, TX (US); Thales De Oliveira, Houston, TX (US); John Algeroy, Houston, TX (US); Michael William Rea, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 916 days.

(21) Appl. No.: 13/898,745

(22) Filed: May 21, 2013

(65) Prior Publication Data

US 2013/0327572 A1 Dec. 12, 2013

Related U.S. Application Data

(60) Provisional application No. 61/657,106, filed on Jun. 8, 2012.

(51) Int. Cl.
*E21B 7/06* (2006.01)
*E21B 41/00* (2006.01)
(Continued)

(52) U.S. Cl.
CPC ..... *E21B 41/0035* (2013.01); *E21B 7/06* (2013.01); *E21B 17/028* (2013.01); *E21B 47/12* (2013.01)

(58) Field of Classification Search
CPC .... E21B 41/0035; E21B 41/0042; E21B 7/06; E21B 17/028
See application file for complete search history.

(56) References Cited

U.S. PATENT DOCUMENTS 2,214,064 A 9/1940 Niles
2,379,800 A 7/1945 Hare
(Continued)

FOREIGN PATENT DOCUMENTS

EP 795679 A2 9/1997
EP 823534 A1 2/1998
(Continued)

OTHER PUBLICATIONS

Brown, G.A., SPE 62952. "Using Fibre-Optic Distributed Temperature Measurements to Provide Real-Time Reservoir Surveillance Data on Wytch Farm Field Horizontal Extended-Reach Wells" Society of Petroleum Engineers Inc. 2000, pp. 1-11.
(Continued)

*Primary Examiner* — David J Bagnell
*Assistant Examiner* — Kristyn A Hall

(57) ABSTRACT

A lateral wellbore completion apparatus may include a flow-through deflector having a deflector face and a junction string that includes a junction block cooperative to mate with the deflector face, a downhole device, and an inductive coupler electrically connected to the downhole device. A method may include anchoring the deflector in a main bore, making-up at the drilling surface a junction string that includes a junction block, a completion string section having a downhole device, and a secondary inductive coupler electrically connected to the downhole device, running the junction string into the main bore, deflecting the completion string section into the lateral bore, and landing the junction block on the deflector face thereby communicatively coupling the secondary and primary inductive couplers.

18 Claims, 7 Drawing Sheets

(51) Int. Cl.
*E21B 17/02* (2006.01)
*E21B 47/12* (2012.01)

(56) References Cited

U.S. PATENT DOCUMENTS 2,452,920 A 11/1948 Gilbert
2,470,303 A 5/1949 Greenough
2,782,365 A 2/1957 Castel
2,797,893 A 7/1957 McCune et al.
2,889,880 A 6/1959 Hughes
3,011,342 A 12/1961 Simm
3,199,592 A 8/1965 Jacob
3,206,537 A 9/1965 Steward
3,344,860 A 10/1967 Voetter
3,363,692 A 1/1968 Bishop
3,659,259 A 4/1972 Chaney, Jr. et al.
3,913,398 A 10/1975 Curtis
4,027,286 A 5/1977 Marosko
4,133,384 A 1/1979 Allen et al.
4,241,787 A 12/1980 Price
4,415,205 A 11/1983 Rehm et al.
4,484,628 A 11/1984 Lammon, II
4,559,818 A 12/1985 Tsang et al.
4,573,541 A 3/1986 Josse et al.
4,597,290 A 7/1986 Bourdet et al.
4,733,729 A 3/1988 Copeland
4,806,928 A 2/1989 Veneruso
4,850,430 A 7/1989 Copeland et al.
4,901,069 A 2/1990 Veneruso
4,945,995 A 8/1990 Tholance et al.
4,953,636 A 9/1990 Mohn
4,969,523 A 11/1990 Martin et al.
5,183,110 A 2/1993 Logan et al.
5,269,377 A 12/1993 Martin
5,278,550 A 1/1994 Rhein-Knudsen et al.
5,301,760 A 4/1994 Graham
5,311,936 A 5/1994 McNair et al.
5,318,121 A 6/1994 Brockman et al.
5,318,122 A 6/1994 Murray et al.
5,322,127 A 6/1994 McNair et al.
5,325,924 A 7/1994 Bangert et al.
5,330,007 A 7/1994 Collins et al.
5,337,808 A 8/1994 Graham
5,353,876 A 10/1994 Curington et al.
5,388,648 A 2/1995 Jordan, Jr.
5,398,754 A 3/1995 Dinhoble
5,411,082 A 5/1995 Kennedy
5,427,177 A 6/1995 Jordan, Jr. et al.
5,435,392 A 7/1995 Kennedy
5,439,051 A 8/1995 Kennedy et al.
5,454,430 A 10/1995 Kennedy et al.
5,457,988 A 10/1995 Delatorre
5,458,199 A 10/1995 Collins et al.
5,458,209 A 10/1995 Hayes et al.
5,462,120 A 10/1995 Gondouin
5,472,048 A 12/1995 Kennedy et al.
5,474,131 A 12/1995 Jordan, Jr. et al.
5,477,923 A 12/1995 Jordan, Jr. et al.
5,477,925 A 12/1995 Trahan et al.
5,499,680 A 3/1996 Walter et al.
5,520,252 A 5/1996 McNair
5,521,592 A 5/1996 Veneruso
5,533,573 A 7/1996 Jordan, Jr. et al.
5,542,472 A 8/1996 Pringle et al.
5,597,042 A 1/1997 Tubel et al.
5,655,602 A 8/1997 Collins
5,680,901 A 10/1997 Gardes
5,697,445 A 12/1997 Graham
5,706,896 A 1/1998 Tubel et al.
5,730,219 A 3/1998 Tubel et al.
5,823,263 A 10/1998 Morris et al.
5,831,156 A 11/1998 Mullins
5,842,528 A * 12/1998 Johnson ..... E21B 4/02 166/278
5,871,047 A 2/1999 Spath et al.
5,871,052 A 2/1999 Benson et al.
5,875,847 A 3/1999 Forsyth
5,915,474 A 6/1999 Buytaert et al.
5,918,669 A 7/1999 Morris et al.
5,941,307 A 8/1999 Tubel
5,941,308 A 8/1999 Malone et al.
5,944,107 A 8/1999 Ohmer
5,944,108 A 8/1999 Baugh et al.
5,944,109 A 8/1999 Longbottom
5,945,923 A 8/1999 Soulier
5,954,134 A 9/1999 Longbottom
5,959,547 A 9/1999 Tubel et al.
5,960,873 A 10/1999 Alexander et al.
5,967,816 A 10/1999 Sampa et al.
5,971,072 A 10/1999 Huber et al.
5,975,204 A 11/1999 Tubel et al.
5,979,559 A 11/1999 Kennedy
5,992,519 A 11/1999 Ramakrishnan et al.
6,003,606 A 12/1999 Moore et al.
6,006,832 A 12/1999 Tubel et al.
6,035,937 A 3/2000 Gano et al.
6,046,685 A 4/2000 Tubel
6,053,254 A 4/2000 Gano
6,061,000 A 5/2000 Edwards
6,065,209 A 5/2000 Gondouin
6,065,543 A 5/2000 Gano et al.
6,073,697 A 6/2000 Parlin et al.
6,076,046 A 6/2000 Vasudevan et al.
6,079,488 A 6/2000 Begg et al.
6,079,494 A 6/2000 Longbottom et al.
6,119,780 A 9/2000 Christmas
6,125,937 A 10/2000 Longbottom et al.
6,173,772 B1 1/2001 Vaynshteyn
6,173,788 B1 1/2001 Lembcke et al.
6,176,308 B1 1/2001 Pearson
6,176,312 B1 1/2001 Tubel et al.
6,192,980 B1 2/2001 Tubel et al.
6,192,988 B1 2/2001 Tubel
6,196,312 B1 3/2001 Collins et al.
6,209,648 B1 4/2001 Ohmer et al.
6,244,337 B1 6/2001 Cumming et al.
6,302,203 B1 10/2001 Rayssiguier et al.
6,305,469 B1 10/2001 Coenen et al.
6,310,559 B1 10/2001 Laborde et al.
6,318,469 B1 11/2001 Patel
6,328,111 B1 12/2001 Bearden et al.
6,349,770 B1 2/2002 Brooks et al.
6,354,378 B1 3/2002 Patel
6,360,820 B1 3/2002 Laborde et al.
6,374,913 B1 4/2002 Robbins et al.
6,378,610 B2 4/2002 Rayssiguier et al.
6,415,864 B1 7/2002 Ramakrishnan et al.
6,419,022 B1 7/2002 Jernigan et al.
6,457,522 B1 10/2002 Bangash et al.
6,481,494 B1 11/2002 Dusterhoft et al.
6,510,899 B1 1/2003 Sheiretov et al.
6,513,599 B1 2/2003 Bixenman et al.
6,515,592 B1 2/2003 Babour et al.
6,533,039 B2 3/2003 Rivas et al.
6,568,469 B2 5/2003 Ohmer et al.
6,577,244 B1 6/2003 Clark et al.
6,588,507 B2 7/2003 Dusterhoft et al.
6,614,229 B1 9/2003 Clark et al.
6,614,716 B2 9/2003 Plona et al.
6,618,677 B1 9/2003 Brown
6,668,922 B2 12/2003 Ziauddin et al.
6,675,892 B2 1/2004 Kuchuk et al.
6,679,324 B2 1/2004 Den Boer et al.
6,695,052 B2 2/2004 Branstetter et al.
6,702,015 B2 3/2004 Fielder, III et al.
6,727,827 B1 4/2004 Edwards et al.
6,749,022 B1 6/2004 Fredd
6,751,556 B2 6/2004 Schroeder et al.
6,758,271 B1 7/2004 Smith
6,768,700 B2 7/2004 Veneruso et al.
6,776,256 B2 8/2004 Kostyuchenko et al.
6,787,758 B2 9/2004 Tubel et al.
6,789,621 B2 9/2004 Wetzel et al.
6,789,937 B2 9/2004 Haddad et al.

(56) References Cited

U.S. PATENT DOCUMENTS 6,817,410 B2 11/2004 Wetzel et al.
6,828,547 B2 12/2004 Tubel et al.
6,830,106 B2 12/2004 Cavender
6,837,310 B2 1/2005 Martin
6,842,700 B2 1/2005 Poe
6,845,819 B2 1/2005 Barrett et al.
6,848,510 B2 2/2005 Bixenman et al.
6,856,255 B2 2/2005 Chalitsios et al.
6,857,475 B2 2/2005 Johnson
6,863,127 B2 3/2005 Clark et al.
6,863,129 B2 3/2005 Ohmer et al.
6,864,801 B2 3/2005 Tabanou et al.
6,896,074 B2 5/2005 Cook et al.
6,903,660 B2 6/2005 Clark et al.
6,911,418 B2 6/2005 Frenier
6,913,083 B2 7/2005 Smith
6,920,395 B2 7/2005 Brown
6,942,033 B2 9/2005 Brooks et al.
6,950,034 B2 9/2005 Pacault et al.
6,975,243 B2 12/2005 Clark et al.
6,978,833 B2 12/2005 Salamitou et al.
6,980,940 B1 12/2005 Gurpinar et al.
6,983,796 B2 1/2006 Bayne et al.
6,989,764 B2 1/2006 Thomeer et al.
7,000,696 B2 2/2006 Harkins
7,000,697 B2 2/2006 Goode et al.
7,007,756 B2 3/2006 Lerche et al.
7,040,402 B2 5/2006 Vercaemer
7,040,415 B2 5/2006 Boyle et al.
7,055,604 B2 6/2006 Jee et al.
7,063,143 B2 6/2006 Tilton et al.
7,079,952 B2 7/2006 Thomas et al.
7,083,452 B2 8/2006 Eriksson et al.
7,093,661 B2 8/2006 Olsen
7,866,414 B2 1/2011 Patel
2001/0013410 A1 8/2001 Beck et al.
2002/0007948 A1 1/2002 Bayne et al.
2002/0050361 A1 5/2002 Shaw et al.
2002/0096333 A1 7/2002 Johnson et al.
2002/0112857 A1 8/2002 Ohmer et al.
2003/0137302 A1 7/2003 Clark et al.
2003/0137429 A1 7/2003 Clark et al.
2003/0141872 A1 7/2003 Clark et al.
2003/0150622 A1 8/2003 Patel et al.
2003/0221829 A1 12/2003 Patel et al.
2004/0010374 A1 1/2004 Raghuraman et al.
2004/0094303 A1 5/2004 Brockman et al.
2004/0129458 A1* 7/2004 Rodgers ..... E21B 41/0035 175/61
2004/0159435 A1 8/2004 Plucheck et al.
2004/0164838 A1 8/2004 Hall et al.
2004/0173350 A1 9/2004 Wetzel et al.
2004/0173352 A1 9/2004 Mullen et al.
2004/0194950 A1 10/2004 Restarick et al.
2004/0238168 A1 12/2004 Echols
2004/0262006 A1 12/2004 Dewey et al.
2005/0072564 A1 4/2005 Grigsby et al.
2005/0074210 A1 4/2005 Grigsby et al.
2005/0083064 A1 4/2005 Homan et al.
2005/0087368 A1 4/2005 Boyle et al.
2005/0092488 A1 5/2005 Rodet et al.
2005/0092501 A1 5/2005 Chavers et al.
2005/0115741 A1 6/2005 Terry et al.
2005/0149264 A1 7/2005 Tarvin et al.
2005/0168349 A1 8/2005 Huang et al.
2005/0178554 A1 8/2005 Hromas et al.
2005/0194150 A1 9/2005 Ringgenberg
2005/0199401 A1 9/2005 Patel et al.
2005/0236161 A1 10/2005 Gay et al.
2005/0274513 A1 12/2005 Schultz et al.
2005/0279510 A1 12/2005 Patel et al.
2006/0000604 A1 1/2006 Jenkins et al.
2006/0000618 A1 1/2006 Cho et al.
2006/0006656 A1 1/2006 Smedstad
2006/0016593 A1 1/2006 Gambier
2006/0042795 A1 3/2006 Richards
2006/0060352 A1 3/2006 Vidrine et al.
2006/0065444 A1 3/2006 Hall et al.
2006/0077757 A1 4/2006 Cox et al.
2006/0086498 A1 4/2006 Wetzel et al.
2006/0090892 A1 5/2006 Wetzel et al.
2006/0090893 A1 5/2006 Sheffield
2006/0124297 A1 6/2006 Ohmer
2006/0124318 A1 6/2006 Sheffield
2006/0137874 A1* 6/2006 Araque ..... E21B 47/09 166/255.3
2006/0162934 A1 7/2006 Shepler
2006/0196660 A1 9/2006 Patel
2006/0225926 A1 10/2006 Madhavan et al.
2006/0254767 A1 11/2006 Pabon et al.
2006/0283606 A1 12/2006 Partouche et al.
2007/0012436 A1 1/2007 Freyer
2007/0027245 A1 2/2007 Vaidya et al.
2007/0044964 A1 3/2007 Grigar et al.
2007/0059166 A1 3/2007 Sheth et al.
2007/0062710 A1 3/2007 Pelletier et al.
2007/0074872 A1 4/2007 Du et al.
2007/0102197 A1* 5/2007 Rotthaeuser ..... E21B 17/003 175/320
2007/0107907 A1 5/2007 Smedstad et al.
2007/0110593 A1 5/2007 Sheth et al.
2007/0116560 A1 5/2007 Eslinger
2007/0142547 A1 6/2007 Vaidya et al.
2007/0144738 A1 6/2007 Sugiyama et al.
2007/0144746 A1 6/2007 Jonas
2007/0151724 A1 7/2007 Ohmer et al.
2007/0159351 A1 7/2007 Madhavan et al.
2007/0162235 A1 7/2007 Zhan et al.
2007/0165487 A1 7/2007 Nutt et al.
2007/0199696 A1 8/2007 Walford
2007/0213963 A1 9/2007 Jalali et al.
2007/0216415 A1 9/2007 Clark et al.
2007/0227727 A1 10/2007 Patel et al.
2007/0235185 A1 10/2007 Patel et al.
2007/0271077 A1 11/2007 Kosmala et al.
2009/0008078 A1* 1/2009 Patel ..... E21B 34/10 166/50

FOREIGN PATENT DOCUMENTS

EP 1158138 A2 11/2001
EP 0786578 B1 12/2005
GB 2274864 A 8/1994
GB 2304764 A 3/1997
GB 2333545 A 7/1999
GB 2337780 A 12/1999
GB 2345137 A 6/2000
GB 2360532 A 9/2001
GB 2364724 A 2/2002
GB 2376488 A 12/2002
GB 2381281 A 4/2003
GB 2392461 A 3/2004
GB 2395315 A 5/2004
GB 2395965 A 6/2004
GB 2401385 A 11/2004
GB 2401430 A 11/2004
GB 2401889 A 11/2004
GB 2404676 A 2/2005
GB 2407334 A 4/2005
GB 2408327 A 5/2005
GB 2409692 A 7/2005
GB 2416871 A 2/2006
GB 2419619 A 5/2006
GB 2419903 A 5/2006
GB 2426019 A 11/2006
GB 2428787 A 2/2007
RU 2136856 C1 9/1999
RU 2146759 C1 3/2000
RU 2171363 C1 7/2001
RU 2239041 C2 10/2004
WO 199623953 A1 8/1996
WO 1998050680 A2 11/1998
WO 1998050680 A3 11/1998
WO 199858151 A1 12/1998

(56) References Cited

FOREIGN PATENT DOCUMENTS

| | | | |
|---|---|---|---|
| WO | 199913195 | A1 | 3/1999 |
| WO | 200029713 | A2 | 5/2000 |
| WO | 200171155 | A1 | 9/2001 |
| WO | 200198632 | A1 | 12/2001 |
| WO | 2003023185 | A1 | 3/2003 |
| WO | 2004076815 | A1 | 9/2004 |
| WO | 2004094961 | A1 | 11/2004 |
| WO | 2005035943 | A1 | 4/2005 |
| WO | 2005064116 | A1 | 7/2005 |
| WO | 2006010875 | A1 | 2/2006 |

OTHER PUBLICATIONS

Saputelli, L. et al. "Real-Time Decision-making for Value Creation while Drilling" SPE/IADC Middle East Drilling Technology Conference & Exhibition, Oct. 2003.

Lanier et al. "Brunei Field Trial of a Fibre Optic Distributed Temperature Sensor (DTS) System in 1,DOOm Open Hole Horizontal Oil Producer" SPE 84324; SPE Annual Technical Conference and Exhibition, Oct. 5-8, 2003.

International Search Report and Written Opinion dated Aug. 27, 2013 for International Patent Application No. PCT/US2013/042850, 14 pages.

* cited by examiner

LATERAL WELLBORE COMPLETION APPARATUS AND METHOD

BACKGROUND

This section provides background information to facilitate a better understanding of the various aspects of the disclosure. It should be understood that the statements in this section of this document are to be read in this light, and not as admissions of prior art.

Maximum and extreme reservoir contact wells are drilled and completed with respect to maximizing total hydrocarbon recovery. These wells may be long and horizontal, and in some cases may have multiple lateral branches. Sensors and flow control devices are often installed in these lateral branches to facilitate hydrocarbon recovery.

SUMMARY

The lateral wellbore completion apparatus and methods provide for completing a lateral bore and communicatively coupling the downhole devices located in the lateral wellbore with a primary inductive coupler located in the main bore. According to an embodiment, a lateral wellbore completion apparatus includes a flow-through deflector having a deflector face and a junction string that includes a junction block cooperative to mate with the deflector face, a downhole device, and an inductive coupler electrically connected to the downhole device. An embodiment of a method for completing a lateral wellbore includes anchoring a flow-through deflector in a main bore that has a primary inductive coupler; making-up at the drilling surface a junction string that includes a junction block, a downhole device, and a secondary inductive coupler electrically connected to the downhole device; running the junction string into the main bore; deflecting a completion string section with the downhole tool into the lateral bore; landing the junction block on the deflector face; and communicatively coupling the secondary inductive coupler with the primary inductive coupler in response to the landing. An embodiment of a well system includes a flow-through deflector located in a main bore and a junction string having a completion string section with a downhole device located in the lateral bore, a junction block landed on the flow-through deflector, and a secondary inductive coupler communicatively coupled with the primary inductive coupler, the secondary inductive coupler electrically connected to the downhole device by a conductor.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of lateral wellbore completion apparatus and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
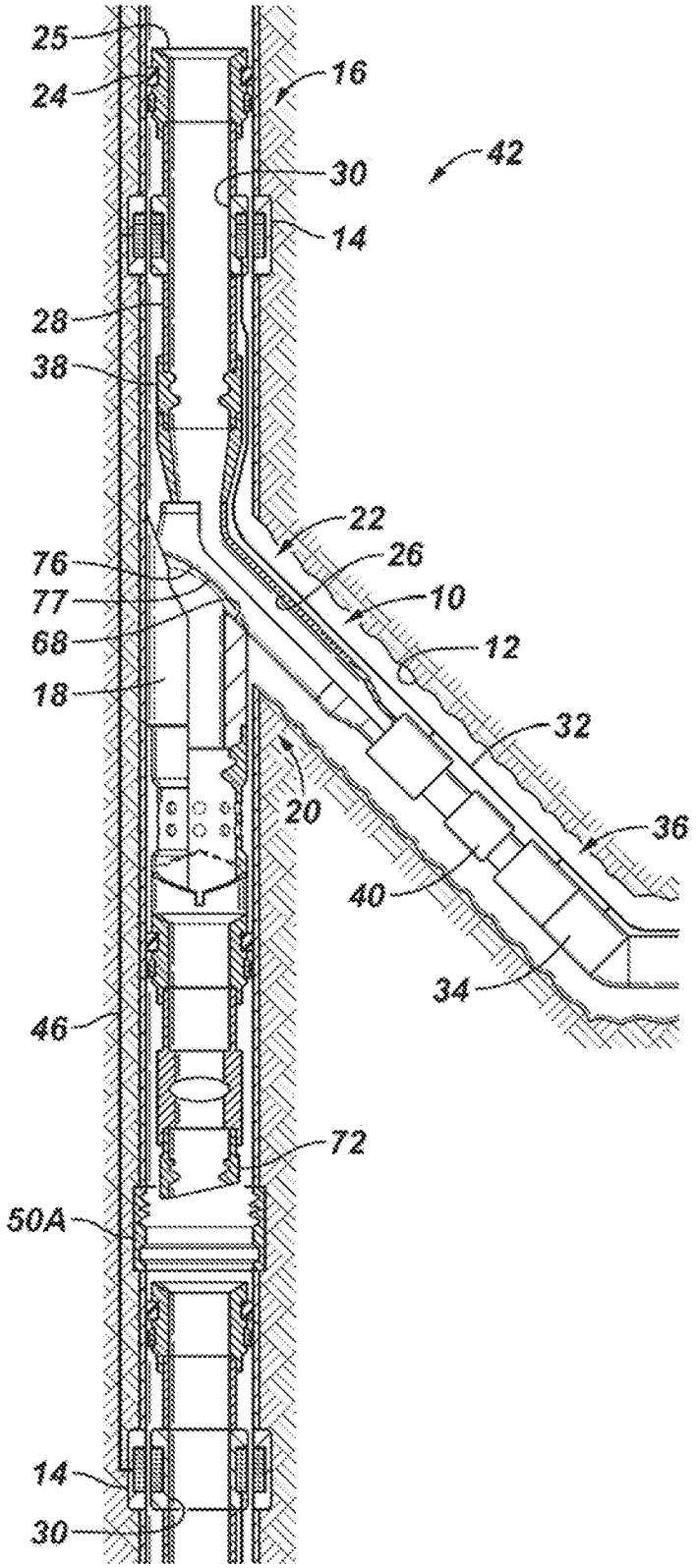
FIG. 1 illustrates a lateral wellbore completion apparatus installed in a lateral bore and providing electric communication between the lateral wellbore completion and a primary inductive coupler in a main bore in accordance to one or more embodiments.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". Further, the terms "communicatively coupled" and similar terms may mean "electrically or inductively coupled" for purposes of passing data and power either directly or indirectly between two points. As used herein, the terms "up" and "down"; "upper" and "lower"; "top" and "bottom"; and other like terms indicating relative positions to a given point or element are utilized to more clearly describe son e elements. Commonly, these terms relate to a reference point as the surface from which drilling operations are initiated as being the top point and the total depth being the lowest point, wherein the well (e.g., wellbore, borehole) is vertical, horizontal or slanted relative to the surface.

Embodiments of lateral wellbore completions generally relate to the completion of wells (e.g., multilateral wells) having at least one lateral branch extending from a main wellbore section. The main bore and lateral bores may each include one or more zones that are isolated from other zones for example by the use of reservoir isolation devices (e.g., packers). One or more downhole devices, such as flow control devices (FCDs), pumps, and measurement sensors (e.g., pressure, temperature, flow rate, density, FCD position indicator, etc.) may be included in the completed zones.

One or more electric cables may be run from the drilling surface (e.g. surface controller) to provide communication and/or electrical power to primary inductive couplers located in the main bore. The primary inductive couplers may serves as stations at which secondary inductive couplers can communicatively couple downhole devices. According to some embodiments, a lateral wellbore completion can be installed to complete a lateral bore and electrically couple the downhole devices of the lateral wellbore completion with a primary inductive coupler completing a junction between the main bore and the lateral bore. The lateral wellbore completion may provide for later through-tubing intervention.

FIG. 1 illustrates an example of a lateral wellbore completion apparatus, generally denoted by the numeral 10, installed in a lateral bore 12 and providing electrical communication between lateral wellbore completion apparatus 10 devices and a casing inductive coupler 14, referred to from time to time herein as a primary inductive coupler 14, located in the main, or mother, bore 16.

According to one or more embodiments, lateral wellbore completion apparatus 10 includes a flow through deflector 18 (e.g., production deflector) set in main bore 16 proximate the junction 20 between lateral bore 12 and main bore 16 and a junction string 22. Junction string 22 includes a lateral completion string section 36 that is installed in lateral bore 12. Junction string 22 as depicted in FIG. 1 includes an anchor device 24, referred to as packer 24, to anchor a top end 25 of junction string 22 in main bore 16; a junction block 26 having a low-side window 76 (FIG. 7) to mate or align with production deflector face 68 (FIGS. 4, 5); a tubular extension 28 (e.g., space out extension) located between junction block 26 and packer 24 carrying a secondary inductive coupler 30 for mating with a primary inductive coupler 14 located above lateral bore 12 in this example, and an electrical cable 32 connected to secondary inductive couplet 30 and one or more downhole devices 34 located in the lateral completion string section 36 section of junction string 22; and an intervention profile 38 (e.g., landing device, mule shoe) for later landing and orienting through-tubing intervention devices, e.g., lateral intervention deflector device 88 (FIG. 9) and main bore intervention device 106 (FIG. 10). Downhole devices 34 can include without limitation sensors, flow control devices, valves, pumps and other devices that may transmit and/or receive electrical signals and/or receive electrical power via the connection of secondary inductive coupler 30 and primary inductive coupler 14.

In accordance with some embodiments, junction string 22 includes a selectable swivel 40 (e.g., swivel and controllable lock) located downhole of junction block 26 to permit junction block 26 to rotate free of lateral completion stung section 36 when orienting and landing junction block 26 with flow through deflector 18. In a locked position, swivel 40 rotationally locks junction block 26 with lateral completion string section 36.

Figure 2:
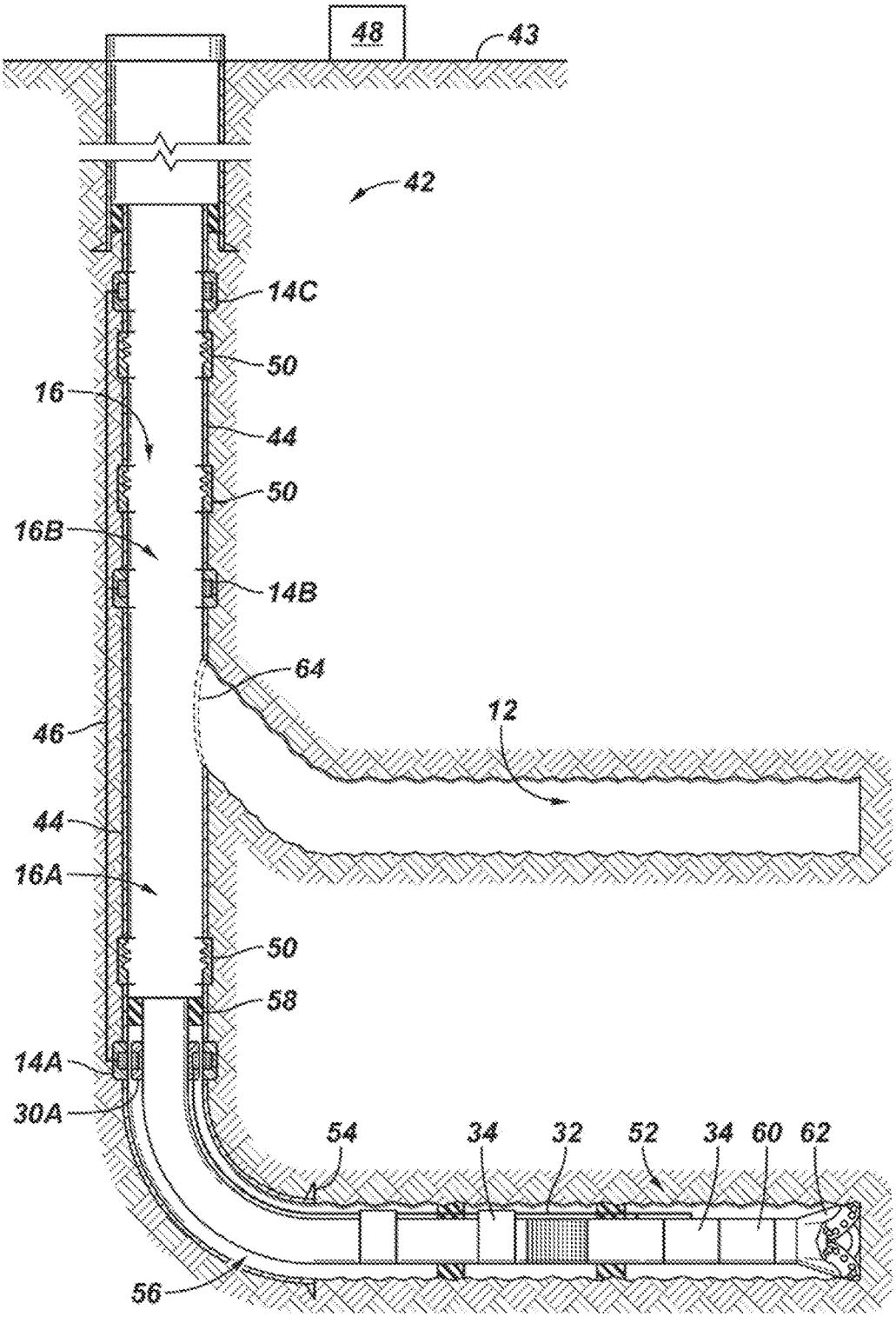
FIGS. 2, 3, and 6 illustrate a well system being completed with a lateral wellbore completion in accordance with one or more embodiments.

Examples of methods of completing a lateral bore 12 with a lateral wellbore completion 10 in accordance to one or more embodiments is now described with reference to FIGS. 1 through 8. FIG. 2 illustrates a well system 42 having a main bore 16 extending into the ground from a surface 43 (e.g., drilling surface). Main bore 16 is completed with casing 44 (e.g., liner) having spaced apart casing inductive couplers 14, also referred to herein as primary inductive couplers 14, located at predetermined locations. The primary inductive couplers are generally identified by the numeral 14 and from time to time individually identified by 14A, 14B, 14C, etc. in reference to the illustrated examples. A single primary electrical cable 46, generally referred to as a conductor, is depicted extending exterior of casing 44 and is connected to each of the primary inductive couplers 14 to communicate for example control signals, data and electrical power between the primary inductive couplers 14 and a surface device 48. Surface device 48 may be a monitoring and/or control station for example. In some embodiments, surface device 48 may be located intermediate to surface 43 and primary inductive couplers 14. Surface device 48 may be a transmitter/receiver configured to allow for monitoring and control of the well from a remote site. Surface device 48 may be provided at a terrestrial or subsea location. Surface device 48 may comprise multiple components or a single component. Primary conductor 46 may be communicatively coupled to a surface device 48, depicted at surface 43, for example and without limitation via wireless connection with the upper most primary inductive coupler 14C, via wired pipe, primary conductor 46 extending to surface device 48, and an upper tubing conductor inductively coupling surface device 48 and a primary inductive coupler 14, e.g., FIG. 8. Downhole devices 34 are communicatively coupled with surface device 48 via the inductive coupling of secondary inductive couplers 30 with primary inductive couplers 14. Secondary inductive couplers are identified individually from time to time by 30A, 30B, 30C etc. in reference to the illustrated examples.

Casing string 44 includes indexed casing couplings (ICC), generally denoted by the numeral 50 and individually from time to time by 50A, 50B, etc. located at predetermined locations. Indexed casing couplings 50 provide a means for locating devices in main bore 16, for example, to align secondary inductive couplers 30 with primary inductive couplers 14. In another example, primary conductor 46 may be rotated, for example 90 degrees, at each casing 44 joint above an ICC 50 providing a means to mill a window in casing 44 without cutting primary conductor 46. Each indexed casing coupler may have a selective internal profile different from one or all of the other ICCs to facilitate positioning of specific landing tools.

Main bore 16 is drilled and casing 44, primary inductive couplers 14, primary conductor 46, and indexed casing couplers 50 may be cemented in place. In the depicted embodiment a lower branch 52 (e.g., bore) is drilled from the bottom 54 of casing 44. A lateral completion 56 is installed in lower branch 52. In the depicted embodiment, lateral completion 56 extends from packer 58 set in casing 44 to a sacrificial motor 60, and drill bit 62. Lateral completion 56 includes a secondary inductive coupler 30A communicatively coupled with primary inductive coupler 14A. An electrical conductor 32 extends from secondary inductive coupler 30A to one or more downhole devices 34 (e.g., FCDs, valves, sensors, pumps, etc.). After lower branch 52 is completed lateral bore 12 is drilled. Lateral bore 12 extends from a window 64 milled through casing 44.

Figure 3:
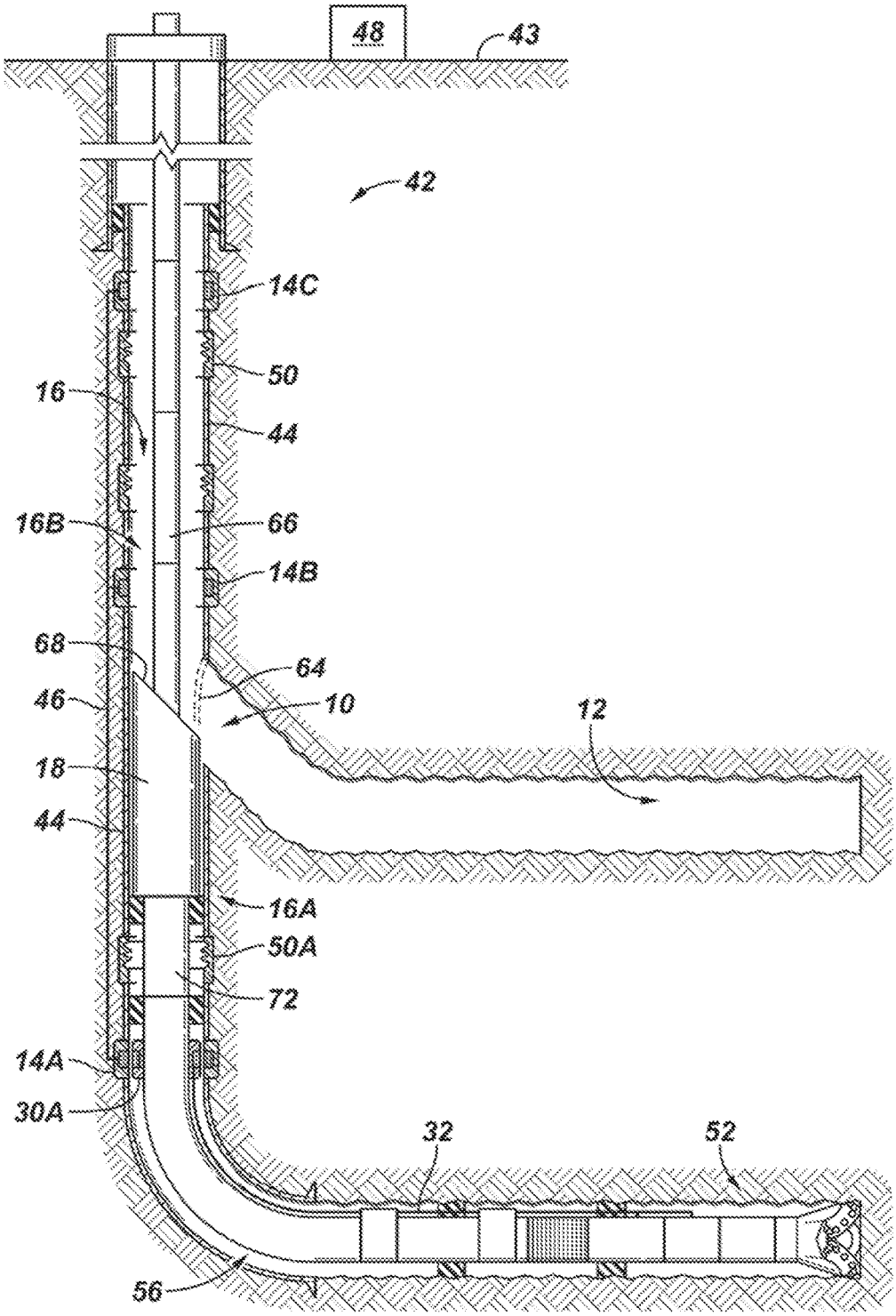
Figure 4:
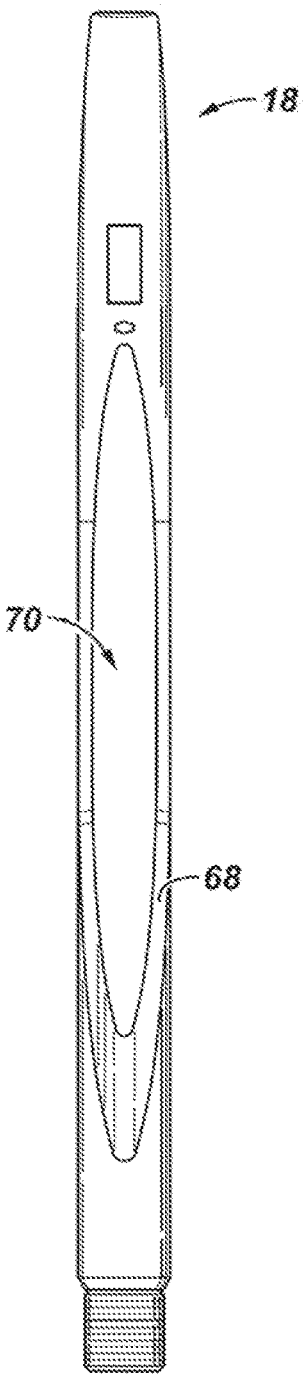
FIG. 4 is an elevation view of a flow-through deflector of a lateral wellbore completion in accordance to one or more embodiments.
Figure 5:
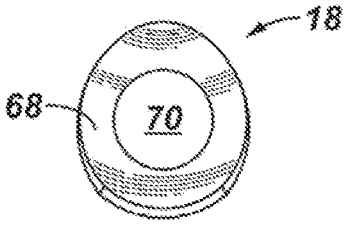
FIG. 5 is a top view of a flow-through deflector of a lateral wellbore completion in accordance to one or more embodiments.

Referring now to FIG. 3, flow-through deflector 18 of lateral wellbore completion 10 is depicted being deployed in main bore 16 on a tubular string 66. In this example, flow-through deflector 18 is deployed on an internal running tool. An example of flow-through deflector 18 is illustrated in FIGS. 4 and 5. Referring to FIG. 4, depicted flow-through deflector 18 is an elongated tubular member having a hollowed, tapered deflector face 68. Deflector face 68 may be concave shaped to accommodate the corresponding cooperative junction block 26, see, e.g., FIGS. 1, 6, 7; in particular for periphery 77 of low-side window 76 to mate with deflector face 68 to eliminate or limit gaps between junction block 26 and deflector face 68.

Flow-through deflector 18 is landed in a lower portion 16A of main bore 16 below window 64 for example by latching a landing tool 72 with indexed casing coupler 50A. Locating and landing flow-through deflector is with respect to indexed casing coupler 50A operationally positions deflector face 68 relative to window 64. Tubular string 66 (e.g., running string) may include a measurement-while-drilling tool (MWD) to orient flow-through deflector 18 relative to window 64. After flow-through deflector 18 is set in lower main bore portion 16A, running string 66 is disconnected and pulled out of main bore 16.

Figure 6:
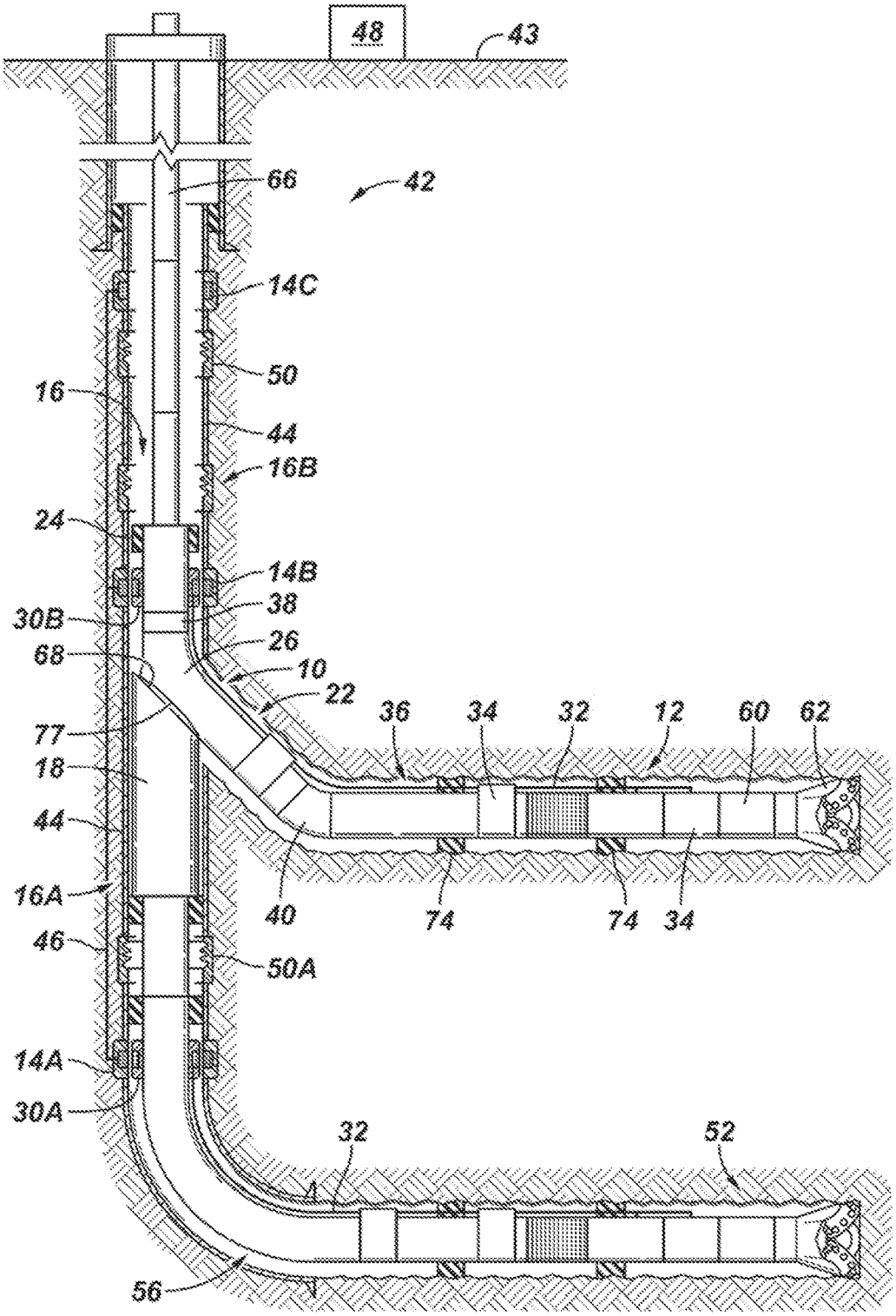

FIG. 6 illustrates a lateral wellbore completion 10 deployed in well system 42. Junction string 22 and lateral completion string section 36 are made-up at surface 43. Lateral completion string section 36 may include various components, including without limitation, a drill bit 62, motor 60, a downhole device 34 (e.g., FCDs, sensors), and formations isolation devices 74 (e.g., packers). In the depicted embodiment, a swivel 40 is connected between junction block 26 and lateral completion string section 36. A secondary inductive coupler 30B is electrically connected to downhole device(s) 34 for example via conductor 32. Junction block 26 is located between secondary inductive coupler 30B and downhole devices 34. Secondary inductive coupler may be located, for example, on a tubular extension 28 between junction block 26 and a packer 24. Secondary inductive coupler 30B is spaced so as to be communicatively coupled with primary inductive coupler 14B when junction block 26 is matingly landed with deflector face 68. Primary inductive coupler 14B is located in the upper main bore 16B. Intervention profile 38 is located in junction string 22 above junction block 26 so as to be disposed in main bore 16. Intervention profile 38 may be configured to locate and position through tubing intervention devices 88, 106 (FIGS. 9, 10) to access lateral bore 12 and/or lower main bore 16A and lower branch 52.

Figure 7:
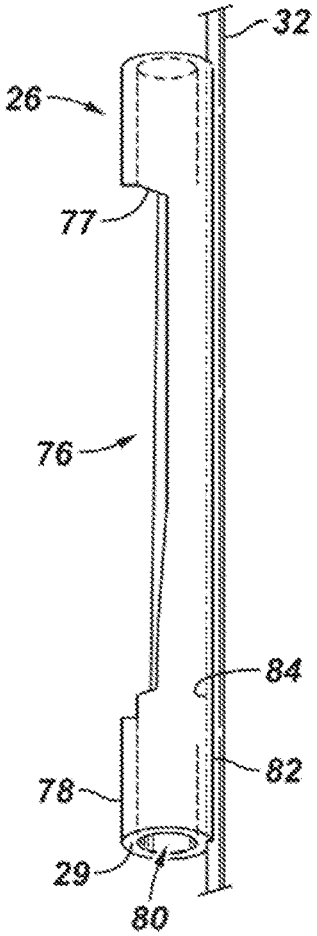
FIG. 7 illustrates a junction block of a lateral wellbore completion in accordance to one or more embodiments.

FIG. 7 illustrates a junction block 26 according to one or more embodiments. Junction block 26 is a substantially tubular member having a window 76 cut out of a side 78 of junction block 26. Side 78 is referred to as the low-side relative to the position of tubular block 26 with the cooperative flow-through deflector 18. The periphery 77 of window 76 is configured to mate with deflector face 68 (FIGS. 4, 5) to minimize or eliminate gaps therebetween. Junction block 26 may have an eccentric bore 80 providing enough wall thickness on the high-side 82 opposite from window 76 to form a groove 84 to dispose electrical conductor 32. Top end 27 and bottom end 29 may include threaded connections for connecting in junction string 22.

Referring back to FIG. 6, junction string 22 with lateral completion string section 36 is run into main bore 16 on tubular string 66. Swivel 40 may be in a locked position rotationally locking junction block 26 and lateral completion string section 36 together. Flow-through deflector 18 will deflects lateral completion string section 36 into lateral bore 12. Drilling fluid may be circulated through tubular string 66 to activate downhole motor 60. Swivel 40 may be activated, for example hydraulically, to an unlocked position allowing junction block 26 to rotate independent of lateral completion string section 36. Deflector face 68 and junction block 26 cooperate to orient low-side 78 (FIG. 7) against deflector face 68 (FIGS. 4, 5) such that periphery 77 of window 76 mates with deflector face 68 and positions secondary inductive coupler 30B in communicative coupling position with primary inductive coupler 14B. Accordingly, each of the downhole devices 34 of junction string 22 are communicatively coupled to primary conductor 46 and thus surface device 48 when junction block 26 is landed on cooperative flow-through deflector 18. It is not necessary for downhole devices 34 to be electrically tied back to primary inductive coupler 14B after junction string 22 is landed.

Communication between cooperative inductive couplers 14B, 30B is confirmed and packer 24 can be set to engage casing 44. Tubular string 66 may be disconnected from junction string 22 and removed from main bore 16.

Figure 8:
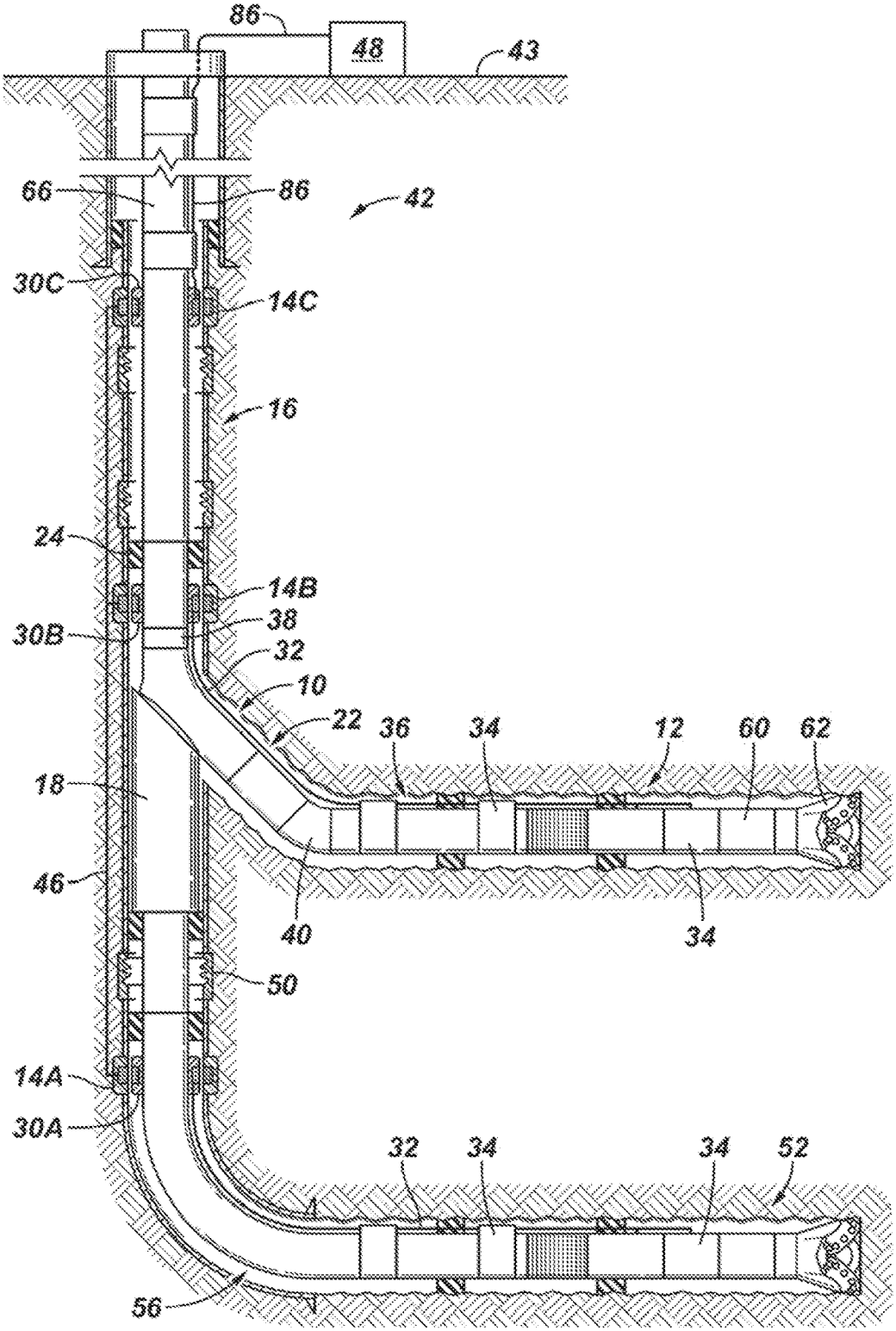
FIG. 8 illustrates a well system completed with a lateral wellbore completion in accordance to one or more embodiments.

Referring now to FIG. 8, well system 42 is depicted completed with a lateral wellbore completion 10. A tubular string 66 is extends from surface 43 into main bore 16 and is depicted connected to production packer 24 of lateral wellbore completion 10. Tubular string 66 is in selective fluid communication with lateral completion 56 disposed in lower lateral branch 52 and lateral branch 12. An electrical conductor 86 electrically connected to surface device 48 extends along tubular string 66 to a secondary inductive coupler 30C located adjacent primary inductive coupler 14C communicatively coupling surface device 48 and all of the primary inductive couplers 14 and downhole devices 34 that are communicatively coupled to primary inductive couplers 14 via secondary inductive couplers 30.

Figure 9:
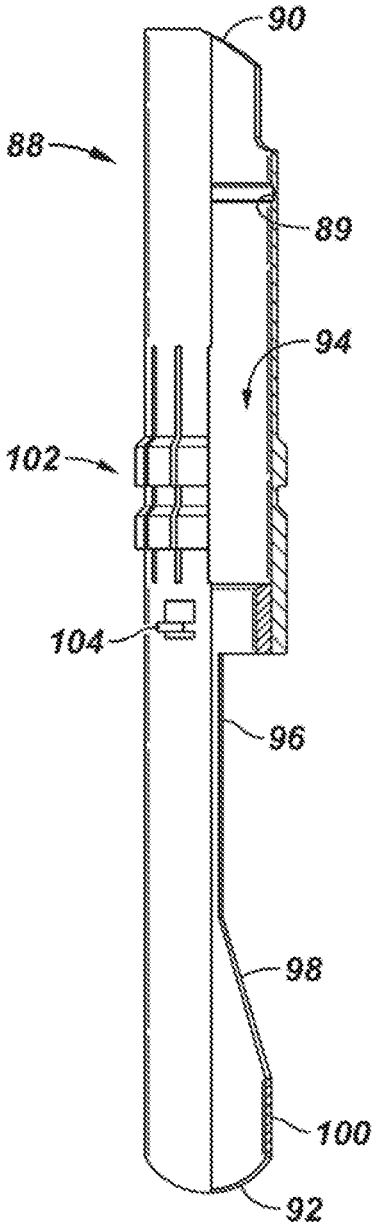
FIG. 9 illustrates a lateral intervention deflector device in accordance to one or more embodiments cooperative with a lateral wellbore completion.
Figure 10:
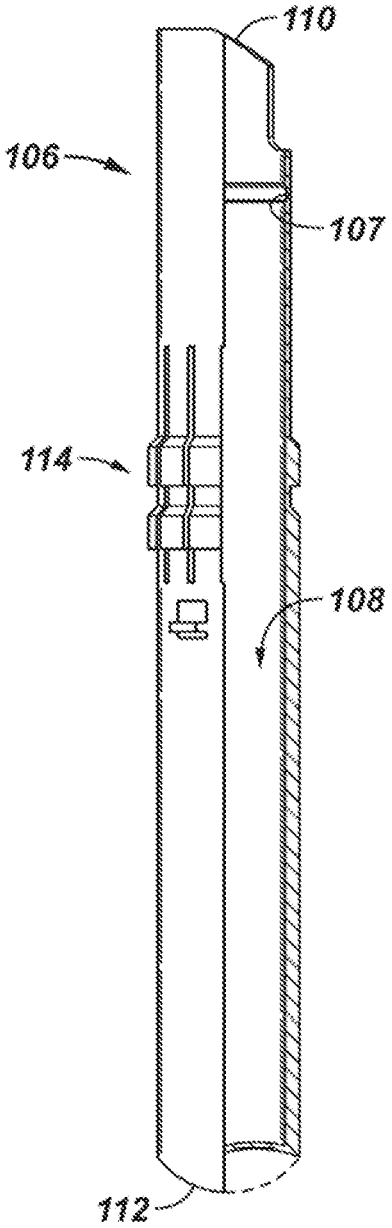
FIG. 10 illustrates a main bore intervention device in accordance to one or more embodiments cooperative with a lateral wellbore completion.

FIG. 9 illustrates a lateral intervention deflector device 88 according to one or more embodiments. Lateral deflector 88 is cooperative with intervention profile 38, see, e.g., FIG. 1, to facilitate through tubing intervention into lateral completion string section 36 and lateral bore 12. For example, lateral deflector 88 may provide for conducting through tubing interventions, such as and without limitation, stimulation, jetting, production logging, pressure build up data, mechanically shifting sleeves (e.g., device 34), and plug and abandonment operations via tubing, coiled tubing, electric line, wireline and slickline. Depicted lateral intervention device 88 includes a running profile 89 located toward top end 90. For example, running neck 89 (e.g., fishing neck) connectable with a running tool, for example a GS tool, and which may serve as a coiled tubing entry guide.

With reference also to FIGS. 1 and 8, lateral deflector 88 extends from a top end 90 to a bottom end 92. An internal bore 94 extends from top end 90 to a slide and glide skirt 96, deflector ramp 98, and guide nose 100. Lateral deflector 88 includes a latch mechanism 102 (e.g., collet) cooperative with selective internal profile 38 and an orientation key 104. To conduct an intervention in lateral bore 12, lateral deflector device 88 can be run, for example, into lateral wellbore completion apparatus 10 through tubular string 66. Lateral deflector device 88 is landed with latch 102 connecting with intervention profile 38. Intervention profile 38 and latch 102 may be selective to permit stacking of lateral wellbore completion apparatuses 10 and intervention devices 88. When landed, guide nose 100 may be disposed in bore 70 (FIG. 4) of flow-through deflector 18 positioning deflector ramp 98 to guide an intervention tool deployed on a conveyance (e.g., coiled tubing, electric line, slickline) into lateral completion string section 36.

FIG. 10 illustrates a main bore intervention device 106 (i.e., isolation device). Main bore intervention device 106 includes a through bore 108 extending from a top end 110 to a bottom end 112, a running neck 107, and a latch 114 (e.g., collet). Latch 114 is cooperative with intervention profile 38 (FIG. 1) to land main bore intervention device 106. Intervention profile 38 and latch 114 may be selective to permit stacking of lateral wellbore completion apparatuses 10 and intervention devices 106. With additional reference to FIGS. 1 and 8, when landed, latch 114 is connected with internal profile 38, bottom end 110 is positioned in bore 70 (FIGS. 4, 5) of flow-through deflector 18 isolating lateral bore 12 from main bore 16 through lateral wellbore completion 10. Accordingly, when an intervention tool is run into the well, the device is muted through main bore intervention device 106 across lateral bore 12 permitting intervention into main bore 16 below lateral bore 12.

The foregoing outlines features of several embodiments of lateral wellbore completion apparatus and methods so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A lateral wellbore completion apparatus, comprising:

a flow-through deflector having a laterally concave, hollowed, tapered deflector face; and a junction string comprising an inductive coupler electrically connected to a downhole device and a junction block positioned between the inductive coupler and the downhole device, the junction block comprising a bore and a low-side having a window to the bore, wherein the low-side is cooperative to mate with the deflector face, wherein the junction block comprises a longitudinal groove formed on an outer surface of a high-side of the junction block, and wherein the inductive coupler is electrically connected to the downhole device by a conductor positioned in the longitudinal groove.

2. The apparatus of claim 1, further comprising a swivel located between the junction block and the downhole device.

3. The apparatus of claim 1, wherein the junction string comprises an intervention profile located on an opposite side of the junction block from the downhole device.

4. The apparatus of claim 1, wherein the downhole device is located in a lateral completion string section of the junction string, the lateral completion string section further comprising:

a drill bit;

a downhole motor; and a formation isolation device.

5. The apparatus of claim 4, further comprising a swivel located between the junction block and the lateral completion string section.

6. The apparatus of claim 1, wherein the junction block comprises an eccentric bore that is closer to the low-side than the high-side.

7. A well system, comprising:

a main bore having primary inductive coupler configured to be communicatively coupled to a surface device;

a lateral bore extending from the main bore;

a flow-through deflector anchored in the main bore, the flow-through deflector having a laterally concave, hollowed, tapered deflector face; and a junction string comprising;

a completion string section located in the lateral bore, the completion string section comprising a downhole device;

a secondary inductive coupler communicatively coupled with the primary inductive coupler, the secondary inductive coupler electrically connected to the downhole device by a conductor; and a junction block landed on the flow-through deflector; wherein the junction block comprises:

a bore and a low-side forming a window, wherein the low-side mates with a deflector face of the flow-through deflector; and a longitudinal groove formed on an outer surface of a high-side of the junction block disposing the conductor extending from the secondary inductive coupler and the downhole device.

8. The well system of claim 7, wherein the junction string comprises a swivel positioned between the junction block and the completion string section.

9. The well system of claim 7, wherein the junction string comprises an intervention profile located in the main bore.

10. The well system of claim 7, wherein the completion string section comprises:

a drill bit;

a downhole motor; and a formation isolation device.

11. The well system of claim 7, further comprising:

a swivel positioned between the junction block and the completion string section;

an intervention profile positioned in the main bore; and a drill bit, a downhole motor, and a formation isolation device located in the completion string section.

12. The well system of claim 7, wherein the junction block comprises an eccentric bore that is closer to the low-side than the high-side.

13. A method for completing a lateral wellbore, comprising:

anchoring a flow-through deflector comprising a laterally concave, hollowed, tapered deflector face in a main bore proximate to a lateral bore, wherein the main bore comprises a primary inductive coupler;

making-up at a drilling surface a junction string comprising a junction block cooperative with the laterally concave, hollowed, tapered deflector face, a completion string section comprising a downhole device, a secondary inductive coupler electrically connected by a conductor to the downhole device, wherein the conductor is disposed in a longitudinal groove formed on an outer surface of junction block, the secondary inductive coupler spaced from the junction block so as to be communicatively coupled to the primary inductive coupler when the junction block is landed on the deflector face;

running the made-up junction string into the main bore toward the hollowed, tapered deflector face;

deflecting the completion string section into the lateral bore in response to contacting the laterally concave, hollowed tapered deflector face;

landing the junction block on the hollowed, tapered deflector face; and communicatively coupling the secondary inductive coupler with the primary inductive coupler in response to landing the junction block on the hollowed, tapered deflector face.

14. The method of claim 13, further comprising unlocking a swivel positioned between the junction block and the completion string section whereby the junction block is rotationally unlocked from the completion string section when landing the junction block on the deflector face.

15. The method of claim 13, wherein;

the junction block a bore and a low-side forming a window; and the landing the junction block comprises mating the low-side of the junction block with the deflector face.

16. The method of claim 13, further comprising operating a downhole motor included in the completion string section after deflecting the completion string section into the lateral bore and before landing the junction block on the deflector face.

17. The method of claim 13, wherein:

the junction block comprises a bore and a low-side forming a window, the low-side configured to mate with the deflector face when the junction block is landed on the deflector face; and the longitudinal groove is formed on a high-side of the junction block disposing the conductor that electrically connects the secondary inductive coupler and the downhole device.

18. The method of claim 13, wherein the junction block comprises an eccentric bore.

* * * * *